US012497780B2

(12) United States Patent
White et al.

(10) Patent No.: US 12,497,780 B2
(45) Date of Patent: Dec. 16, 2025

(54) BUILDING FACADE SYSTEM AND METHOD OF PROVIDING A BUILDING FACADE

(71) Applicant: UBFS LLC, Chicago, IL (US)

(72) Inventors: James Jonathan White, Riverside, IL (US); Edward Mitry Coosaia, Jr., Livermore, CA (US); Jason S. Eastwood, Pittsburg, KS (US)

(73) Assignee: UBFS LLC, Chicago, IL (US)

( * ) Notice: Subject to any disclaimer, the term of this patent is extended or adjusted under 35 U.S.C. 154(b) by 238 days.

(21) Appl. No.: 18/304,634

(22) Filed: Apr. 21, 2023

(65) Prior Publication Data

US 2023/0340788 A1 Oct. 26, 2023

Related U.S. Application Data

(60) Provisional application No. 63/333,421, filed on Apr. 21, 2022.

(51) Int. Cl.

| | |
|---|---|
| ***E04F 13/073*** | (2006.01) |
| ***E04B 2/92*** | (2006.01) |
| ***E04B 2/96*** | (2006.01) |

(52) U.S. Cl.

CPC ..... *E04F 13/073* (2013.01); *E04B 2/96* (2013.01); *E04B 2/92* (2013.01)

(58) Field of Classification Search

CPC ..... E04B 2/88; E04B 2/90; E04B 2/96; E04B 2/965; E04B 2/967; E04F 13/07;

(Continued)

(56) References Cited

U.S. PATENT DOCUMENTS 3,205,630 A 9/1965 Felix et al.
3,465,996 A 9/1969 Wedel (Continued)

FOREIGN PATENT DOCUMENTS

CN 105421629 A 3/2016
EP 1338719 A1 8/2003

(Continued)

OTHER PUBLICATIONS

International Preliminary Report on Patentability received for International PCT Application Serial No. PCT/US2023/066043, dated Oct. 31, 2024, 8 pages.

(Continued)

*Primary Examiner* — Jonathan Liu
(74) *Attorney, Agent, or Firm* — Levenfeld Pearlstein, LLC

(57) ABSTRACT

A building facade system is provided with a unified anchor assembly having an anchor member. The anchor member has a blade portion, an anchor fist and an anchor fork. The blade portion has a head at the proximal end, a lateral surface having serrations and a slotted opening. The anchor fist has a channel and a flange, the channel receives the head of the blade portion to slide within the channel. The anchor fork has tines defining a slot with an opening therebetween and a serrated surface to engage the serrations of the blade portion. Upon installation onto a building, the anchor fork is seated on an upwardly extending flange of a structural member affixed to a building floor slab. The anchor fist is secured to a vertical mullion by shear connection made by fasteners coupling the flange of the anchor fist to a lateral surface of the mullion.

20 Claims, 7 Drawing Sheets

(58) Field of Classification Search
CPC . E04F 13/073; E04F 13/0801; E04F 13/0803; E04F 13/0805; E04F 13/081; E04F 13/0832; E04F 13/0839; E04F 13/0841; E04F 13/15; E04F 13/21; E04F 13/22
See application file for complete search history.

(56) References Cited

U.S. PATENT DOCUMENTS

| | | | | |
|---|---|---|---|---|
| 3,936,986 | A | 2/1976 | Steel | |
| 3,994,107 | A | 11/1976 | Aughuet | |
| 4,073,107 | A | 2/1978 | Rousseau | |
| 4,483,122 | A | 11/1984 | Crandell | |
| 4,782,635 | A | 11/1988 | Hegle | |
| 5,063,718 | A | 11/1991 | Nonis | |
| 5,077,947 | A | 1/1992 | Takeda | |
| 5,158,392 | A | 10/1992 | Takeda | |
| 5,253,459 | A | 10/1993 | Parinas et al. | |
| 6,598,361 | B2 | 7/2003 | Ting | |
| 6,658,804 | B2 | 12/2003 | Leytes et al. | |
| 6,804,920 | B2 | 10/2004 | Hogan | |
| 7,043,884 | B2 | 5/2006 | Moreno | |
| 7,562,504 | B2 | 7/2009 | Herbst et al. | |
| 7,644,549 | B2 | 1/2010 | Speck | |
| 7,827,746 | B2 | 11/2010 | Speck | |
| 8,011,146 | B2 | 9/2011 | Krause | |
| 8,484,916 | B2 | 7/2013 | Farag | |
| 8,567,141 | B2 | 10/2013 | Logan | |
| 8,601,762 | B2 | 12/2013 | Walker, III | |
| 8,615,938 | B2 | 12/2013 | Arbour | |
| 8,955,285 | B2 | 2/2015 | Fournier et al. | |
| 9,032,681 | B1 | 5/2015 | Brady | |
| 9,175,471 | B2 | 11/2015 | Ting | |
| 9,200,444 | B2 * | 12/2015 | Ra | E04B 2/90 |
| 9,683,367 | B1 | 6/2017 | Ting | |
| 9,752,319 | B1 | 9/2017 | Levan | |
| 9,896,840 | B2 | 2/2018 | Ting | |
| 10,041,256 | B2 | 8/2018 | Scully et al. | |
| 10,094,111 | B2 | 10/2018 | Levan | |
| 10,202,763 | B2 | 2/2019 | Hogan et al. | |
| 10,202,764 | B2 | 2/2019 | Levan | |
| 10,233,638 | B2 | 3/2019 | Levan | |
| 10,526,791 | B2 | 1/2020 | Loyd | |
| 10,669,709 | B2 | 6/2020 | Zemler et al. | |
| 10,724,234 | B2 | 7/2020 | Levan | |
| 11,396,750 | B2 | 7/2022 | White et al. | |
| 11,879,249 | B1 * | 1/2024 | Phelps | G02F 1/133308 |
| 2003/0033765 | A1 | 2/2003 | Ting | |
| 2006/0016133 | A1 | 1/2006 | Speck | |
| 2007/0022682 | A1 * | 2/2007 | Morgenegg | E04B 2/90 52/235 |
| 2007/0039258 | A1 | 2/2007 | Walker, III | |
| 2010/0257812 | A1 * | 10/2010 | Schultz | E04B 2/96 52/704 |
| 2012/0102860 | A1 | 5/2012 | Ander et al. | |
| 2013/0014636 | A1 * | 1/2013 | Dehghanyar | E04H 9/06 89/36.02 |
| 2013/0186031 | A1 * | 7/2013 | Ting | E04B 1/388 52/698 |
| 2014/0144093 | A1 | 5/2014 | Shriver | |
| 2014/0157718 | A1 * | 6/2014 | Fournier | E04B 2/90 52/707 |
| 2015/0135615 | A1 | 5/2015 | Hogan et al. | |
| 2016/0298338 | A1 | 10/2016 | Libreiro et al. | |
| 2017/0254074 | A1 | 9/2017 | Levan | |
| 2017/0350117 | A1 | 12/2017 | Hogan et al. | |
| 2017/0362826 | A1 | 12/2017 | Levan | |
| 2018/0245341 | A1 * | 8/2018 | Boucher | E06B 3/66304 |
| 2018/0334799 | A1 | 11/2018 | Andresen et al. | |
| 2019/0071863 | A1 | 3/2019 | Ting | |
| 2019/0093349 | A1 | 3/2019 | Levan | |
| 2022/0025651 | A1 | 1/2022 | White et al. | |
| 2022/0282479 | A1 * | 9/2022 | Budd | E04B 1/41 |

FOREIGN PATENT DOCUMENTS

| | | | |
|---|---|---|---|
| GB | 2464483 | A | 4/2010 |
| JP | S57112540 | A | 7/1982 |
| JP | S5931344 | A | 2/1984 |
| JP | S61166004 | U | 10/1986 |
| JP | H0346083 | Y2 | 9/1991 |
| JP | H0420889 | Y2 | 5/1992 |
| JP | H04107311 | U | 9/1992 |
| RU | 73909 | U1 | 6/2008 |

OTHER PUBLICATIONS

"2500 UT Unitwall® System", Kawneer Company, Inc., EC 97911-263, Mar. 2022, 7 pages.
Sharma, Mayank, "A Passive Route to Fire Safe Facade Construction", WFM Media Magazine, online available at <https://wfmmedia.com/firestop-facade-system/>, Dec. 17, 2020, 15 pages.
"Curtain Wall Facades", HILTI, online available at <https://www.hilti.sa/content/dam/documents/pdf/meta_ae/brochure-curtain%20wall%20facades%20d9.pdf>,, Retrieved on Dec. 17, 2018, 140 pages.
Extended European Search Report received for European Patent Application Serial No. 21846973.2 dated Dec. 14, 2023, 9 pages.
"Halfen HCW Curtain Wall: Technical Product Information", Halfen GmbH, Germany, 2014, pp. 1-36.
International Preliminary Report on Patentability received for International PCT Application Serial No. PCT/US2021/013685, mailed on Feb. 2, 2023, 10 pages.
International Search Report and Written Opinion received for PCT Application Serial No. PCT/US2021/013685 dated Aug. 8, 2021, 10 pages.
International Search Report and Written Opinion received for PCT Application Serial No. PCT/US2023/066043 dated Apr. 8, 2021, 28 pages.
"Literature Review on Seismic Performance of Building Cladding Systems", A Report to: U.S. Department of Commerce Technology Administration National Institute of Standards and Technology Building and Fire Research Laboratory Gaithersburg, MD 20899, Cladding Research Institute, Emeryville, Caifornia, Feb. 1995, 182 pages.
"Recommended Practice for Glass Fiber Reinforced Concrete Panels", Precast/Prestressed Concrete Institute, PCI Manual, 4th Edition, 31 pages.
"Signature Series Unit Wall Installation Manual", Oldcastle BuildingEnvelope, Jul. 2013, 23 pages.
"YUW 750 XT—Unitized Curtain Wall System Detail", YKK AP America Inc., Jul. 6, 2015 and Sep. 13, 2016.
Allana, et al., "Curtain Wall Issues, Problems, and Solutions", Symposium on Building Envelope Technology, Oct. 22-23, 2012, pp. 97-111.
Muhammad, Ludifa Barau, "Systematic Evaluation of Curtain Wall Types", Thesis in partial fulfillment of the requirements for the Degree of Master of Science in Architecture at Eastern Mediterranean University, Feb. 2010, Gazimagusa, North Cyprus, 135 pages.
Pond, et al., "The State of Practice of Unitized Curtain Walls", ASCE Library, Structures Congress, Downloaded from ascelibrary.org by University of Birmingham on Aug. 12, 2017.
International Search Report and Written Opinion received for PCT Application Serial No. PCT/US2023/066043 dated Aug. 8, 2023, 28 pages.
International Preliminary Report on Patentability received for International PCT Application Serial No. PCT/US2021/013685, dated Feb. 2, 2023, 10 pages.

* cited by examiner

BUILDING FACADE SYSTEM AND METHOD OF PROVIDING A BUILDING FACADE

CROSS-REFERENCE TO RELATED APPLICATIONS

The present application claims priority to and the benefit of the filing date of U.S. Provisional Patent Application No. 63/333,421 filed Apr. 21, 2022 which is hereby expressly incorporated by reference in its entirety as if set forth fully herein.

FIELD

Embodiments presented herein relate generally to the field of building facade systems which form an envelope of external facade around buildings such as multi-residence or commercial office buildings, high-rise buildings, towers, skyscrapers and the like. More particularly, embodiments disclosed herein provide a universal building facade system anchored from the building floor structure via a shear supported unified anchor innovation.

According to exemplary embodiments, the building facade system presented herein can create a unified anchor without the need for expensive notching of the vertical support members (e.g. mullions) which can usually cause hardship and limited tolerances. Embodiments disclosed herein allow for the benefits of a single unified anchor system without the many drawbacks inherent in a notched vertical system. For example, the system according to embodiments presented herein can require fewer field installed parts than conventional facade systems and can increase labor efficiency of installation while concurrently providing the ability to apply a traditional fire stop in the field as needed. Such design overcomes certain known notched vertical facade systems that rely on a continuous shelf design held in tensile which can obscure the field application of critical life-saving fire stop materials.

BACKGROUND

Two conventional types of building facade systems that are generally known and commonly used are window/hybrid wall and curtainwall. Generally, known curtainwall framework employs a plurality of anchor subassemblies. Each subassembly is comprised of roughly half of a two-part large aluminum mating clip, and can include a Jack bolt, and serrated washer. In assembling such systems, one subassembly is typically pre-attached to the building terminal slab end with a first crew of laborers and the second subassembly is mated to the pre-glazed panel by a second crew of laborers. The two subassemblies that make up the whole anchor are joined together when a third crew of laborers joins the pre-glazed panel anchor subassembly to the subassembly that was attached to the building floor slab. The pre-glazed panel of such systems can have a plurality of anchor parts attached structurally to vertical structures/mullions in a shear or tensile vector.

Conventional curtain wall systems can utilize either notched or unnotched vertical framework. Both notched and unnotched vertical framework is spaced from the terminal edge of a building floor slab by over an inch, or as much as several inches. Such arrangement unfortunately has been shown to provide a direct fire path between floors within twenty (20) minutes should a fire burns through aluminum horizontals. As such, known curtainwall configurations can present a life safety hazard by allowing vertical fire spread if costly fire stop materials/measures are not added.

At least one notched curtain wall design relies upon a continuous shelf held in tensile which prevents the field application of critical life safety fire stop measures in the field. More particularly, such continuous shelf design can obscure access to the gap between the vertical support and the terminal edge of the building floor slab which can require installation of fire safing material onto the building panel before being installed. Such condition can prevent visual verification that that is needed to reliably confirm proper compression of fire safing material and the absence of voids which can compromise the integrity of the fire safing. Apart from critical fire safety limitations, the unprotected gap allowed by notched curtainwall systems also allows for excessive sound to travel upwards to the occupants above.

For curtainwall designs utilizing a continuous shelf member, the inability to install a traditional two-hour rated fire stop and a smoke seal in the field can represent a safety hazard for building occupants. For the safety and health of the building occupants, building codes generally require the implementation of separate firestopping measures, such as fire resistive mineral wool and smoke resistant silicone seals be installed after the panel is affixed to the building to prevent fire and smoke from traveling up the curtain wall between floors. The installation and use of such measures can be expensive, time consuming, and may not be possible with certain continuous-shelf design systems due to the single shelf anchor spanning between vertical members—such condition causing a "blind" application of firestopping materials without sufficient visual verification.

By contrast, window wall systems are generally known to be endo-bearing fenestration systems provided in combination assemblies and composite units, including transparent vision panels and/or opaque glass or metal panels, which span from the top of a floor slab to the underside of the next higher floor slab—using the below floor slabs as structural support. Thus, window wall systems are load-bearing directly on the below floor slab and can be comprised of any number of individual completed window units used to fill a particular exterior opening on a particular floor. Thus, when a window wall system is fully installed within an exterior opening between floors in a building, the system performs independently of other window wall systems in the building.

Conventional building window/hybrid wall framework is generally known to employ a plurality of parts comprising a series of site-installed track parts at the top and bottom face of the terminal end of a floor slab to create a confined opening by two crews of laborers. A third laboring crew then insulates and covers the slab edge using a plurality of site-installed loose shipped parts. A fourth crew installs pre-glazed units within the confines of the top and bottom track system set by the first laboring crew. Thus, the installation process can be labor-intensive. Further, since window walls are endo-bearing, the glass aesthetic design is less continuous and more interrupted. Window walls can also be more susceptible to leaking due to the seals around the panels drying out.

In view of the troublesome deficiencies of known curtainwall systems, there is a need in the art for a building facade system that is capable of providing improved field-applied safety code compliant firestopping and smoke sealing materials, as well as better noise reduction, without requiring excessive installation and/or maintenance time and expense. Innovations presented herein, including the use of the unified anchor that is the first of its kind to allow facade designers to use either a notched or unnotched vertical design, and allow field application of fire safing overcomes deficiencies associated with traditional curtainwall systems and eliminates the need for multiple laboring crews to assemble and install multi-part anchors as described above.

DETAILED DESCRIPTION

Figure 1:
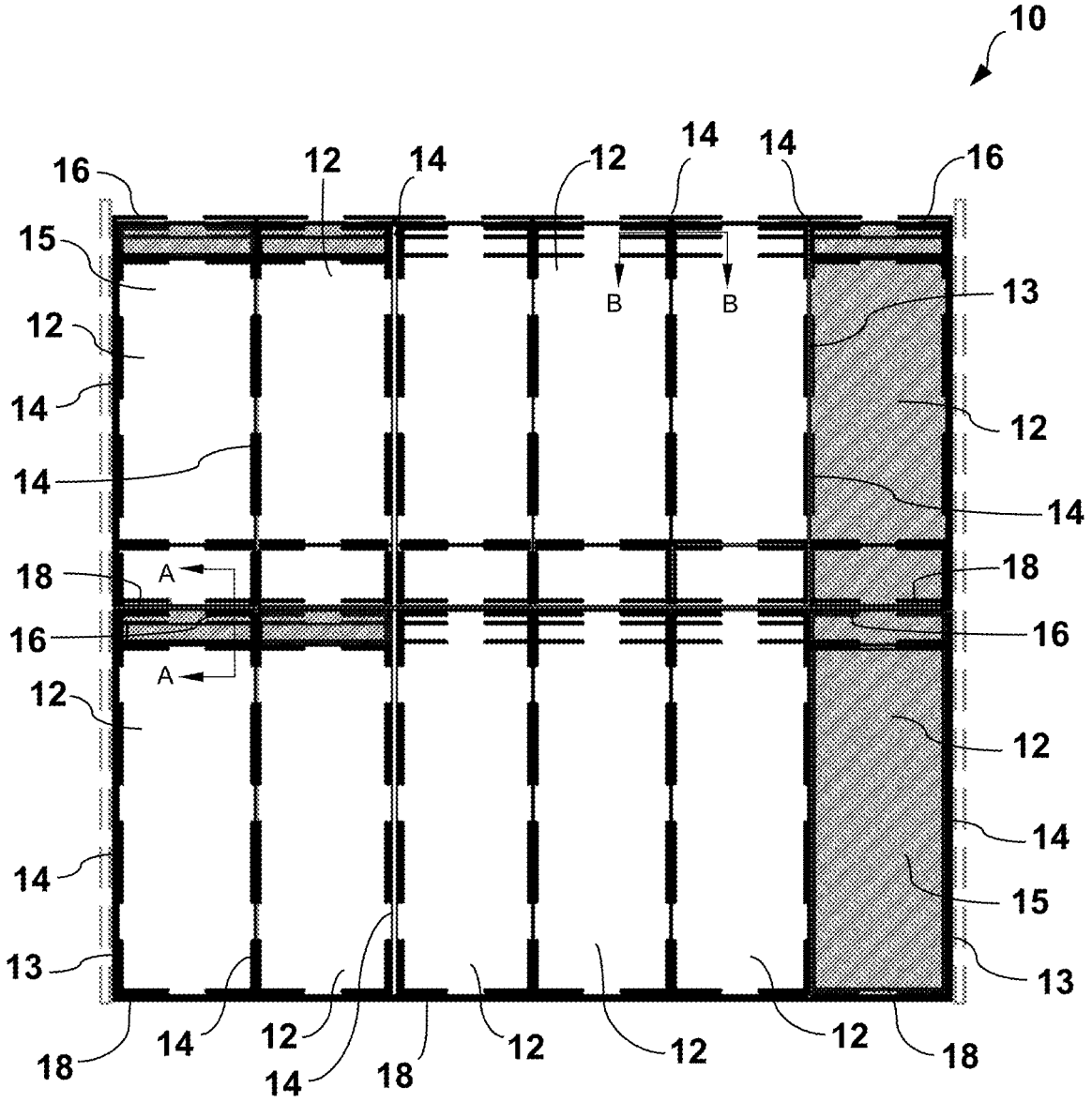
FIG. 1 is a partial front elevation view of a building facade system according to exemplary embodiments provided herein.

While the subject invention is susceptible of embodiment in many different forms, there are shown in the drawings, and will be described herein in specific detail, embodiments thereof with the understanding that the present disclosure is to be considered as an exemplification of the principles of the invention and is not intended to limit the invention to the specific embodiments illustrated.

Embodiments disclosed herein are generally directed to a building facade system and method of forming a building facade system substantially as shown and/or described in connection with the figures and as set forth more fully in the claims. It will be understood from the subject disclosure that embodiments presented herein can allow for the floor slab of a building structure to interface more closely with the interior of the building facade system by way of a unified anchor and an open ended or closed notch of a vertical mullion. Embodiments are further directed to a simple-to-fabricate unnotched application which still provides all the labor savings benefits of a unified anchor assembly opposed to the multi-part anchor assemblies found with traditional curtain walls.

From the subject disclosure, it will be appreciated that the disclosed embodiments present an entirely new type of building facade system which provides for the application of fire stop measures as required for the safety of building occupants and also to meet international and local building codes after installation of the frame onto the floor structure. It will further be appreciated that disclosed embodiments provide a highly variable building facade that is practically universal in application which comprises a first-of-its kind unified anchor that enables a facade designer to use either a notched or unnotched design for vertical support members with the ability to provide critical field-applied fire safing under either condition.

Specific advantages, aspects and novel features of the disclosed system and method, as well as details of the illustrated embodiments thereof, will be more fully understood from the following description and drawings which reference specific embodiments in which the invention can be practiced. The embodiments are intended to describe aspects of the invention in sufficient detail to enable those skilled in the art to practice the invention. Other embodiments can be utilized and changes can be made without departing from the scope of the present invention.

With reference now to the figures, FIG. 1 schematically illustrates a portion of a building facade system 10 constructed in accordance with embodiments provided herein. As shown schematically in FIG. 1, according to exemplary embodiments, building facade system 10 can be comprised of a plurality of panel assemblies 12 comprising at least one building facade panel 15 that can be structurally glazed onto a frame assembly comprised of vertical mullions 14 and horizontal members 16, 18. As shown schematically in FIG. 1, panel assemblies 12 can be arranged side-by-side along a portion of the exterior of a building structure to form a building facade. According to exemplary embodiments, the building facade can be comprised of substantially vertical mullions 14 and horizontal members 16, 18 supported on vertical mullions 14 to comprise a frame 13. Panel assemblies 12 can be aligned both vertically and horizontally side-by-side and end-to-end with seals therebetween to protect the and insulate the interior of the building from precipitation, wind and temperature.

According to exemplary embodiments presented herein, infill panels 13 can enclose the building interior space between successive floor slabs FS. Infill panels can be comprised of vision glass which can be transparent, opaque, tinted, translucent, reflective and/or can be comprised of any other material selected from a group consisting of solid, perforated or patterned, steel, aluminum, glass, gfrc, porcelain, sintered stone, stone and polymers. Infill panels 13 can further be insulated and/or be comprised of one or more layers and can be different dimensions or thicknesses as needed or desired. According to exemplary embodiments, the infill panels can include spandrel cover panels that can be configured to cover the spandrel area around the terminal end of a building floor slab FS. Infill panels 13 can be structurally glazed to the frame 13 including vertical mullions 14 and horizontal members to provide a unified pre-installed panel assembly 12.

FIGS. 2-6 schematically illustrate portions of a building facade system 10 according to exemplary embodiments presented herein and schematically illustrated in FIG. 1. According to exemplary embodiments shown schematically in FIGS. 2-6, the building facade system 10 can comprise a unified panel assembly installed to the terminal end of a building floor slab FS with a notched or unnotched vertical 14 structure and can generally comprise an anchor assembly 20, a vertical mullion 14, horizontal members 16, 18 and building facade panels 15. As shown schematically in FIGS. 2 and 4, building facade system 10 can further comprise an interior trim assembly 30 shown as a floor closure sub-assembly as well as firestopping measures 32, smoke seals 34 and associated fasteners, gaskets, seals, insulation, spacers as will be described further herein.

Figure 2:
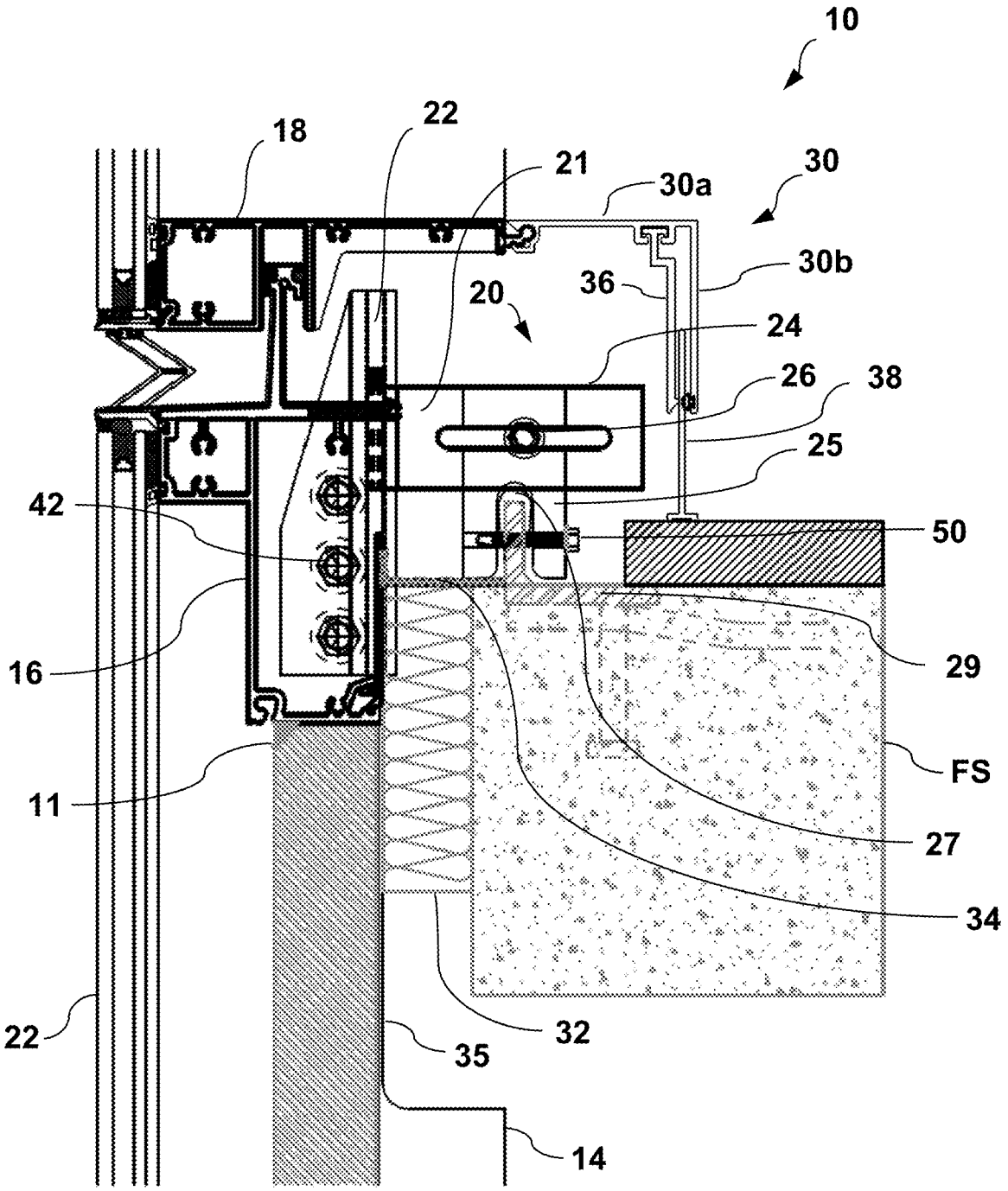
FIG. 2 is a schematic notched vertical cross-section view of a portion of a building facade system according to exemplary embodiments provided herein taken along line A-A of FIG. 1.
Figure 3:
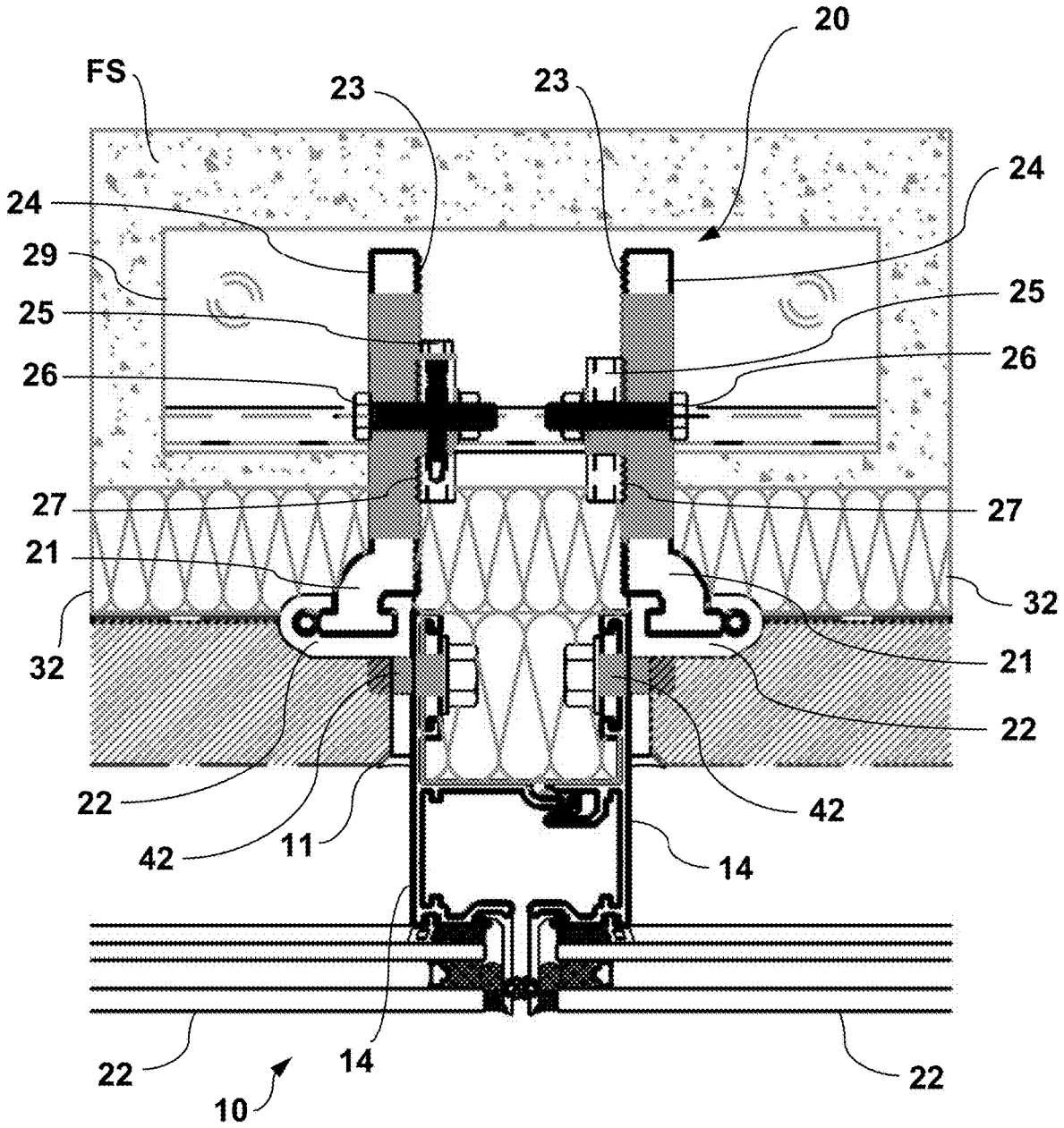
FIG. 3 is a schematic top plan cross-sectional view of a portion of a building facade system for the notched vertical application according to exemplary embodiments provided herein taken along line B-B of FIG. 1.
Figure 4:
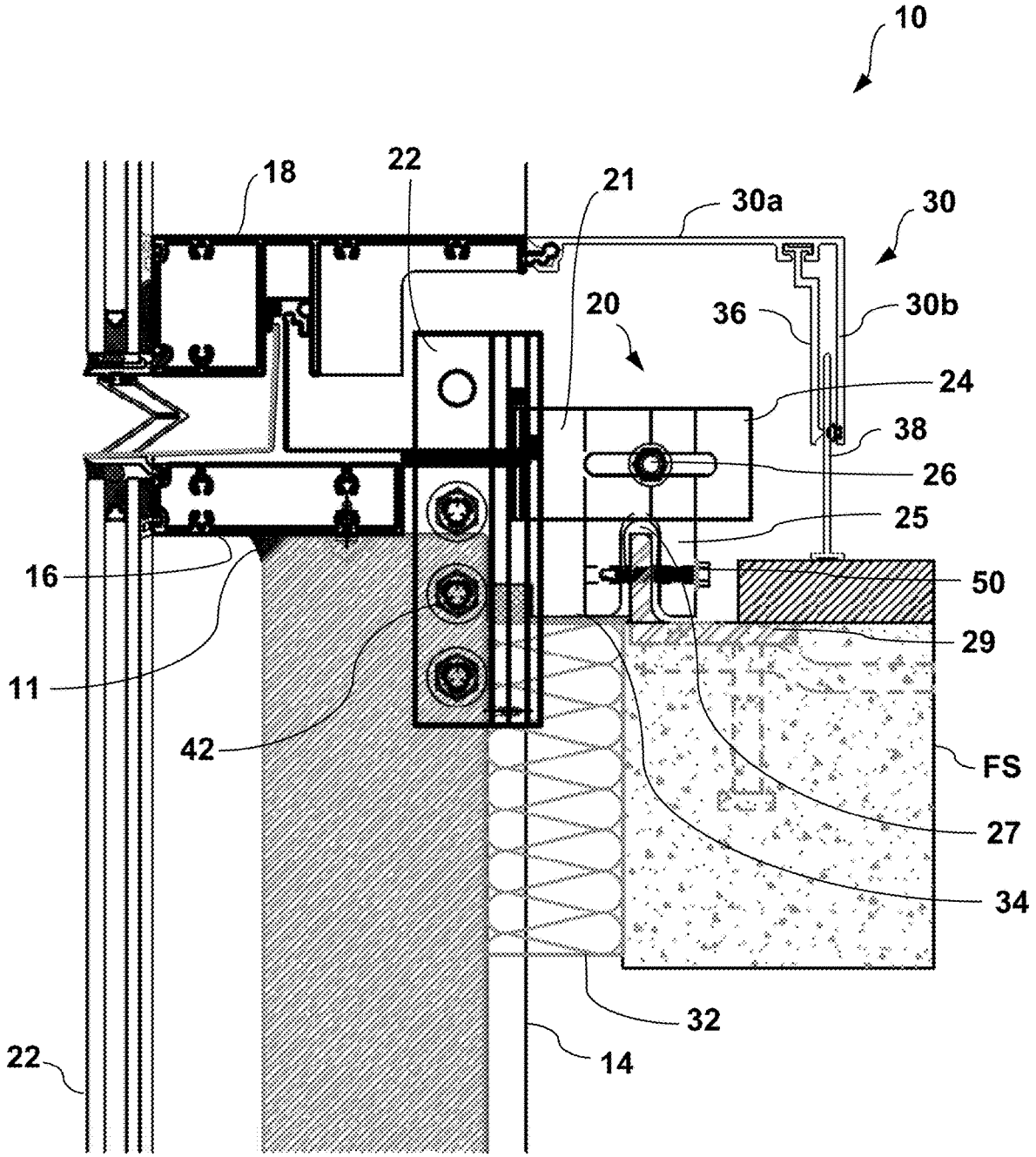
FIG. 4 is a schematic unnotched vertical cross-section view of a portion of a building facade system according to exemplary embodiments provided herein taken along line A-A of FIG. 1.
Figure 5:
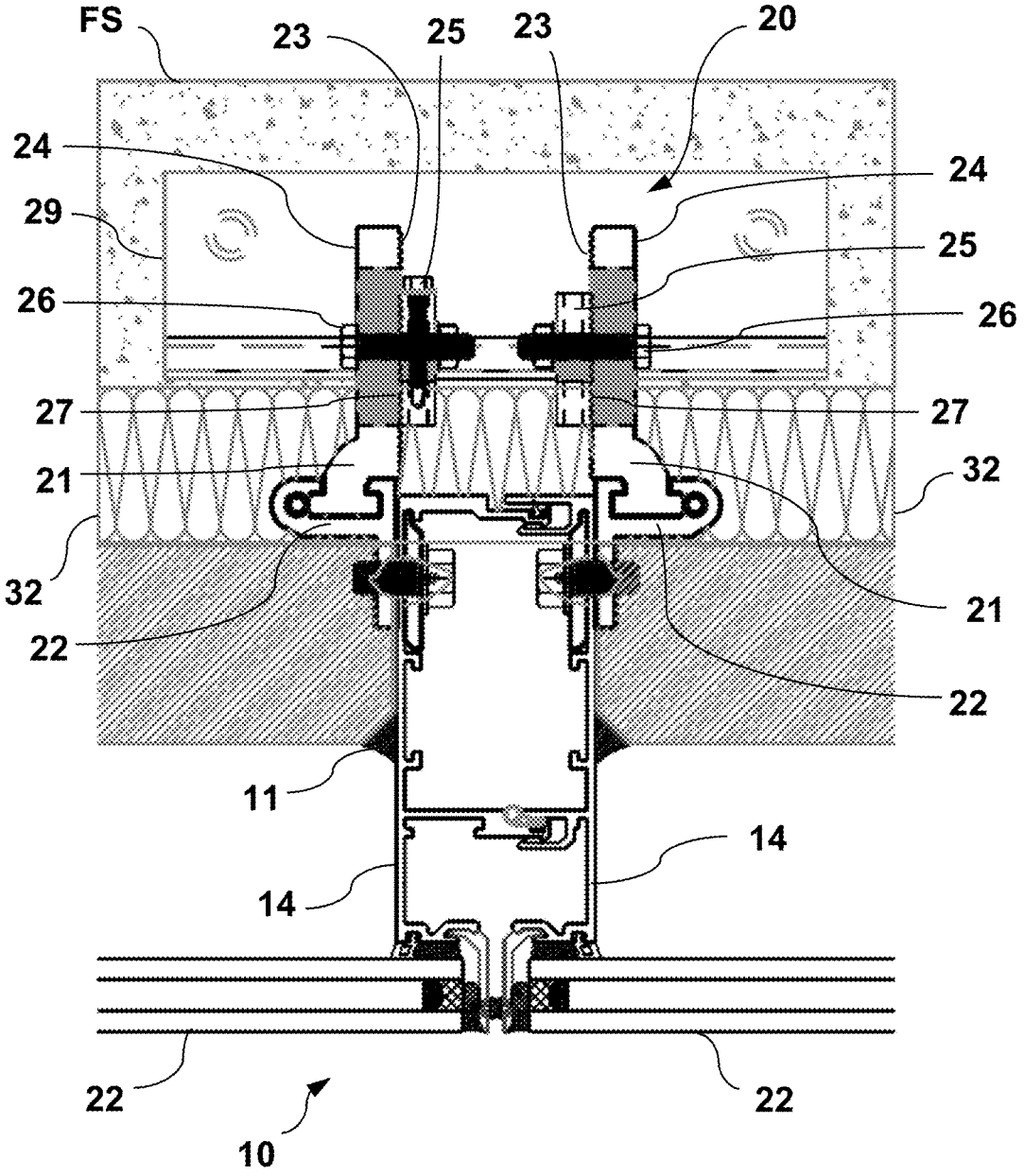
FIG. 5 is a schematic top plan cross-sectional view of a portion of a building facade system for the unnotched vertical application according to exemplary embodiments provided herein taken along line B-B of FIG. 1.
Figure 6:
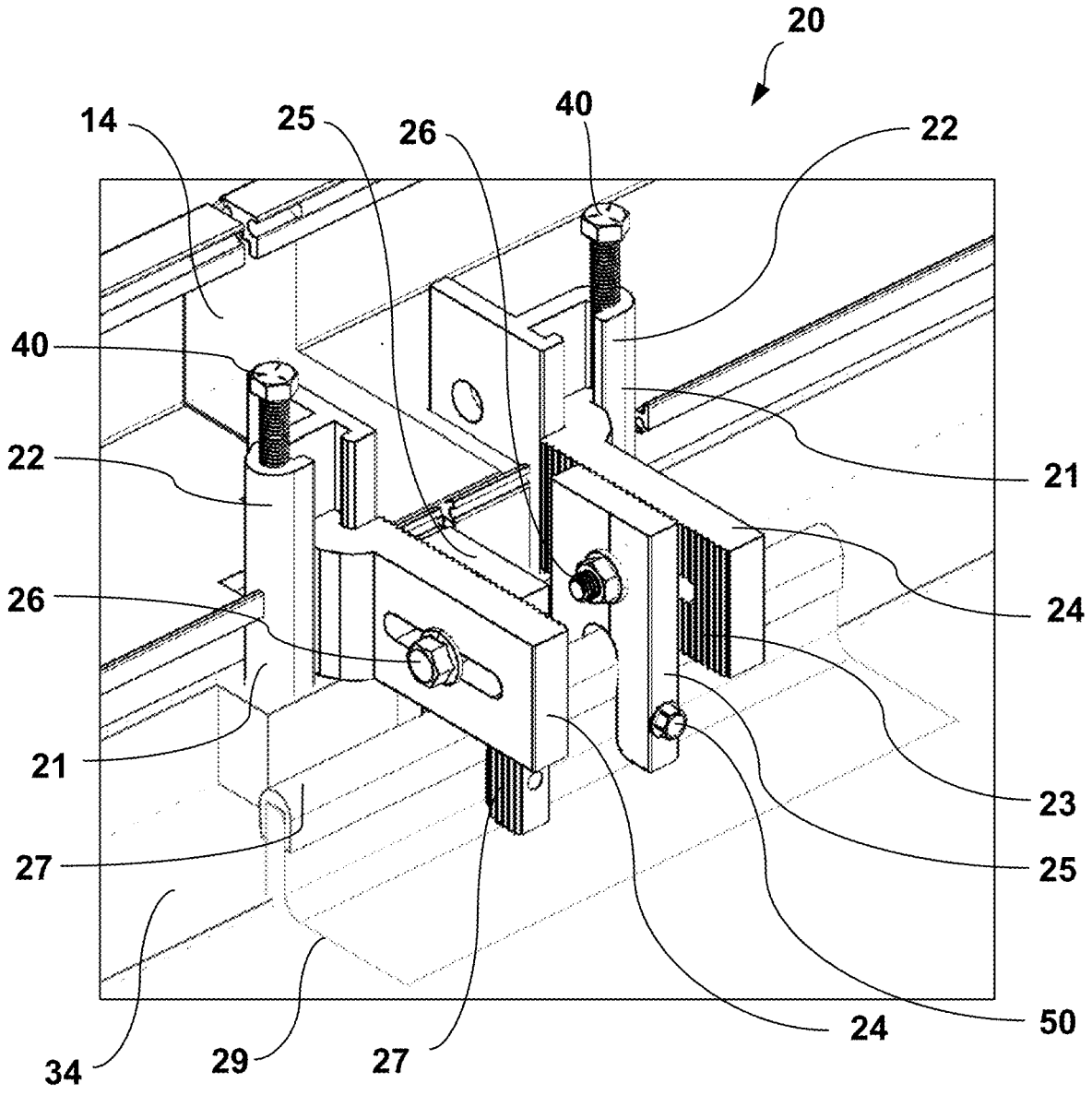
FIG. 6 is an isometric view of an anchor assembly according to embodiments provided herein.

As best seen in FIGS. 2, 4 and 6, an exemplary anchor assembly 20 can be comprised of a plurality of anchor members 21 laterally spaced-apart from one another and secured to opposing sides of a vertical mullion 14. In particular, vertical mullion 14 can be comprised male and female mullion half members that are generally rectangular shaped in cross section and securely snapped together to form vertical mullion 14. According to exemplary embodiments, anchor members 21 of the unified anchor assembly 20 can be secured to the outside surface of each mullion half member by fasteners 42 such as shear bolts extending horizontally therethrough. As is conventionally known, the vertical mullion 14 and horizontal members 16, 18 together form a frame 13 for supporting the building facade infill panels 15. The frame 13 and frame components and hardware can largely be comprised of extruded aluminum, although other materials can also be used without limitation.

A back pan 11, such as a galvanized steel back pan, can be sealed to the frame 13 on all sides. As best shown schematically in FIGS. 2 and 4, a portion of the vertical mullion halves can be provided with a notched section 35 to minimize the distance of the wall of the facade from the terminal face of the floor slab FS and to allow incidental building movements and thermal expansion without compromising the integrity of the building facade. The notched sections 35 (see FIG. 2) can extend along a portion of the length of the vertical mullion 14 and permit the frame 13 to be positioned closer to the terminal edge of the floor slab FS and provide a space for the application of a fire stop 32 and smoke seals 34.

From the subject disclosure it will be readily understood by persons of ordinary skill in the art that FIGS. 2-5 are schematic illustrations of an exemplary anchor location that can be part of a much larger building facade system. In particular, it is generally known that the overall system can encircle an entire exterior of a building structure, or large portions thereof, to span multiple floors to form an exterior facade for the building. Thus, persons of ordinary skill in the art will recognize and appreciate that the portion of the building facade system 10, anchor assembly 20, and other components shown in the FIGS. 2-5 can be provided in pluralities and at numerous locations around the exterior of a building structure in an ordered arrangement. From the subject disclosure it will further be recognized that the building facade system 10 shown and described herein can be comprised of panel assemblies 12 that can be shop assembled and require no pre-attachment of anchors to a building floor structure. Such panel assemblies 12 according to exemplary embodiments can generally comprise unified anchor assemblies 20, frame assemblies 13 comprised of mullions 14 and horizontal members 16, 18 and a building panel 15 structurally glazed onto the frame assembly.

As illustrated schematically in FIGS. 2-5, according to exemplary embodiments the unified anchor assembly 20 can be generally comprised of an anchor member 21, and preferably a pair of anchor members 21. As shown schematically, anchor member 21 can have a blade portion 24 and an extruded anchor fist 22 extending vertically relative the horizontal blade portion 24. Horizontal blade portion 24 can have an inside surface having inwardly projecting serrations 23 along at least a portion thereof. Horizontal blade portion 24 can be affixed to extruded aluminum anchor fork 25 by a horizontal adjustment fastener 26 which can threadingly engage into anchor fork 25.

Extruded aluminum anchor fork 25 can have an outer surface having sawtooth-type serrations 27 comprised of a pattern or series of alternating elongated ridges and grooves; the ridges and grooves extending in a vertical direction across at least a portion of the width of anchor blade 24. The serrations 27 along the outer surface of anchor fork 25 can engage with serrations 23 along the interior side of blade member 24 to facilitate horizontal alignment of the anchor assembly 20 and panel assembly 12 including frame 13 and infill panel 15. As shown schematically in FIGS. 2-6, the blade portion 24 can extend in a first lateral direction from a head portion at the proximal end to an opposing distal end. The serrated services 23 of blade portions of adjacent anchor members 21 can be oriented to face one another, with corresponding serrated surfaces 27 of anchor forks 25 engaged therealong.

According to exemplary embodiments shown schematically in FIGS. 2-5, the blade portion 24 of anchor member 21 can have a proximal end having a head with opposing flanges and a threaded fastener 40 such as a set screw adjacent the head. Anchor fist 22 can have a channel for receiving the head portion of blade 24, the head of blade portion 24 can slide within the vertical channel of anchor fist 22 in a substantially vertical direction to permit vertical adjustment of anchor assembly 20 and the panel assembly 12, including frame and infill panel 15. Such vertical adjustment can be facilitated by rotating fasteners 40 against the head of blade portion 24 within the channel of anchor fist 22. Engagement of the blade portion with the anchor fist can configure the body of the blade portion to extend in a first horizontal direction to a distal end opposite the proximal head portion.

As shown schematically in FIGS. 2-5, anchor fork 25 can have a downward extending tines with a slot therebetween. The slot open at the bottom of fork 25 and can be configured to receive a flange of an embedded angle 29 that can be secured to the top surface of the floor slab FS proximate the terminal edge. Embed angle can comprise a first flange secured to the floor slab and a second flange extending vertically perpendicular thereto. Anchor fork 25 can be seated over the upwardly extending second flange of embedded angle 29 whereby gravity loading the weight of the panel 13 through the anchor blade onto the top of the embedded angle 29. More particularly, the downward opening slot of anchor fork 25 can receive the upward extending flange of embed angle 29. A fastener 50 can be inserted through the tines of the anchor fork 25 and through the upward extending flange of embed angle 29 to further support the anchor assembly 20 thereto.

As shown in FIGS. 2-5, anchor fork 25 can be threadingly engaged to anchor blade 24 by horizontal adjustment fastener 26 which can secure the assembly together. Tightening of horizontal fasteners 26 can enable in-and-out adjustment of the face of frame 13 and infill panel 15. Conversely, loosening of fasteners 26 can allow the frame 13 and panel 15 to slidingly adjust the in-or-out alignment of the face of the panel across the top of the upward facing flange of embed angle 29 which can be covered by an isolator 27. Isolator 27 can be comprised of a plastic or other polymer material and can be secured to the terminal end of the upward-extending flange of emdeb angle 29 to facilitate a precise fit of anchor fork 25 for a solid gravity-loaded connection.

According to exemplary embodiments, the anchor configuration disclosed herein does not require a channel to be embedded into the floor slab FS which ordinarily requires extensive labor and can impede the installation of other utilities within the floor slab such as electrical wiring or plumbing conduits. Such benefit is highly desirable in that it can reduce the overall expense of the building facade and can enable the building designer to embed other useful systems into the floor slab FS without concern of potential interference from an embed channel for supporting the facade system.

According to embodiments presented herein, fasteners 42 securing the unified anchor assembly 20 to the vertical mullion 14 can extend in a second lateral direction and be inserted through holes along a flange portion of the anchor fist 22 through the exterior lateral surfaces of the vertical mullion 14. Such attachment can include a bearing insert to attach the unified anchor assembly 20 to the vertical mullion 14. Bearing insert can be comprised from extruded aluminum or other ridged material without limitation. Thus, according to exemplary embodiments presented herein, vertical mullion 14 can be secured by shear connection to the unified anchor assembly 20 with vertical mullion 14 being held in shear to suspend the frame 13 of panel assembly 12 from the building floor slab FS.

From the subject disclosure, it will be generally understood and appreciated by persons of ordinary skill in the art that the invention and utilization of a unified anchor assembly 20 in accordance with embodiments presented herein can create an entirely new variant of building facade systems that is universal in application and does not required a vertical notch to withstand structural forces. Such features can make the fabrication of the facade system much more cost effective and the application of fire safing much simpler than with a notched vertical member which has been required for all previous unified anchor designs to be structurally adequate for high-rise application. Specifically, such innovation can provide the aesthetic contemplated by all prior types of building facade enclosure systems described above in a single system and further provides dramatically improved design freedom within a single unified chassis. Such capabilities and improvements can be obtained without the need for multiple laboring crews to mate curtainwall framework anchors of the type used with prior curtainwall systems because the frame contains within itself all the required anchor components and eliminates the need to pre-attach anchors to the building while also allowing the installer to install the needed fire safety systems after the frame is affixed to the building. Such capability is not achievable with any known notched curtainwall which may instead rely on a single shelf anchor and in all cases required a vertical notch to reduce the structural eccentricity to permit the unified anchor to perform structurally.

As shown schematically in FIGS. 2 and 4 the interior of horizontal sill member 18 can be configured for attachment of an interior trim assembly 30. Interior trim assembly 30 can have an interior trim body comprising a top panel 30*a* and interior panel 30*b*. The top panel 30*a* of interior trim body can be configured to be secured, such as for example by snap-fit connection, to the inside edge of the horizontal sill member 18. As shown schematically in FIGS. 2 and 4, top panel 30*a* can be substantially horizontal and interior panel 30*b* can extend substantially vertically downward from the inside edge of top panel. Persons of ordinary skill in the art will recognize and appreciate that the size and shape of interior trim body and/or configuration of panels 30*a*, 30*b* can be modified without limitation without departing from the novel scope of embodiments presented herein.

As shown schematically in FIGS. 2 and 4, interior trim assembly 30 can have a trim support member 36 and a trim index 38. Trim assembly 30 including trim body, trim support member 36 and trim index 38 can be made from extruded aluminum and/or other rigid materials without limitation, can be configured to be installed after the frame 13 and anchor assembly 20 are secured in place and after all positional adjustments to the anchor assembly are made. As illustrated, at least a portion of trim support member 36 can extend downward and away from the top panel of trim body and substantially parallel to interior panel 30*b*. Trim index 38 can be provided between trim support member 36 and interior panel 30*b* and a gasket such as a friction or compression gasket can be seated between inside edges of trim support member 36 and interior panel 30*b*. According to exemplary embodiments best shown schematically in FIGS. 2 and 4, trim index 38 can be vertically adjustable and can be slidably engaged through gasket to seal an opening or space between the top surface of the floor slab FS and the terminal end of the interior trim panel 90. Interior finish gaskets and trim index 38 can be provided to accommodate incidental building movements and concrete tolerances. According to exemplary embodiments shown schematically in the figures, trim assembly 30 including trim body, trim support member 36, trim index 38 can be removable to enable access to unified anchors 20.

Figure 7:
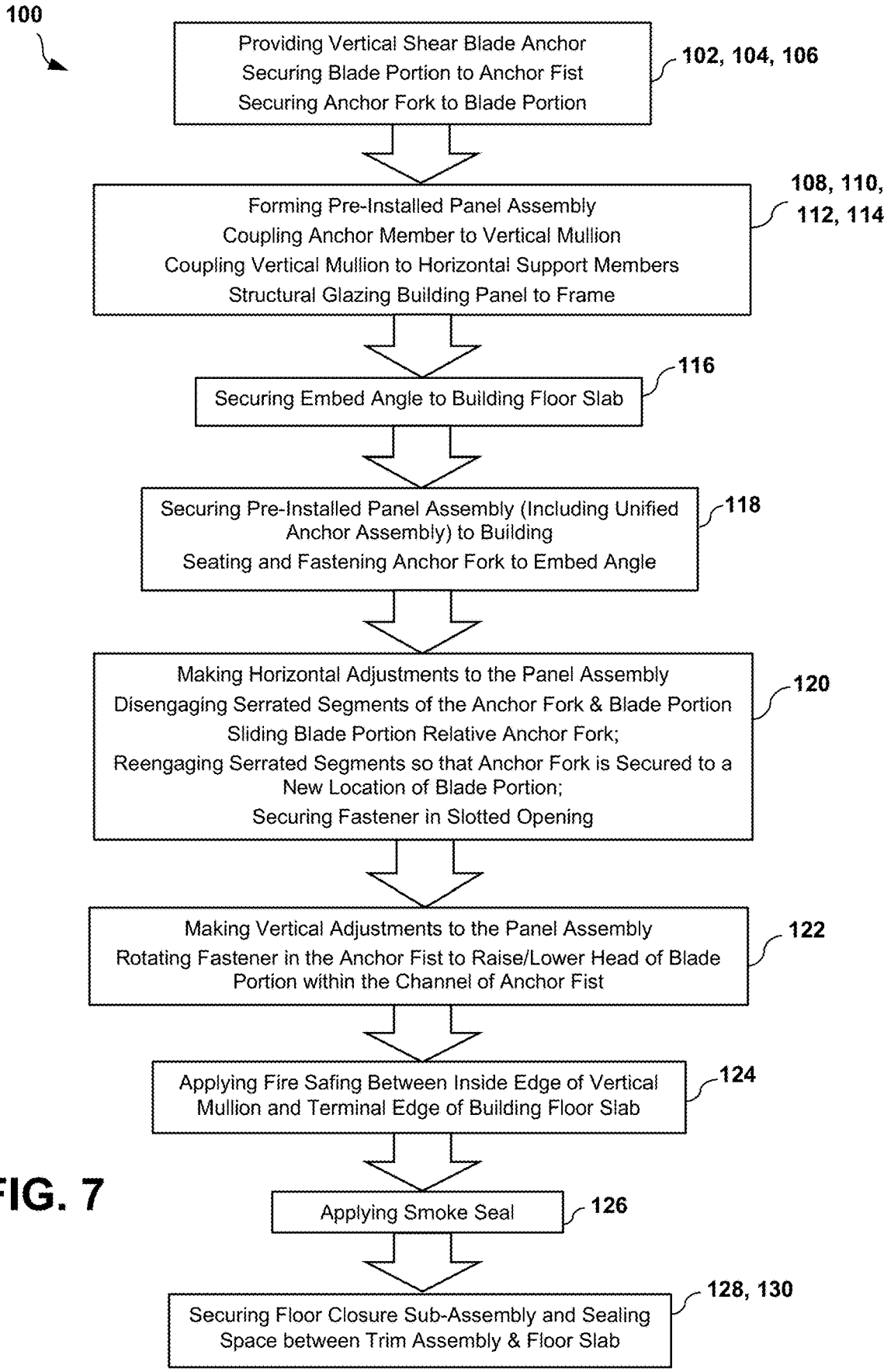
FIG. 7 is a flow diagram of illustrating exemplary steps of a method for installing a building facade system according to embodiments provided herein.

FIG. 7 illustrates exemplary steps of a method 100 for installing a building facade system according to embodiments provided herein. According to exemplary embodiments shown schematically in FIG. 7, the method 100 can comprise providing 102 a unified anchor assembly having an anchor member, and preferably a plurality of anchor members, comprising a blade portion, anchor fist and anchor fork. The blade portion and anchor fork can both have a surface with serrations that can engage one another.

According to exemplary embodiments, the proximal end of the blade portion can be secured 104 within a channel of the anchor fist and the anchor fork can be secured 106 to the body of the blade portion by a threaded fastener extending through a slotted channel through the side of the blade portion and into the anchor fork such that spaced-apart tines of the anchor fork extend downward below the blade portion to define a downward-opening slot therebetween. A unified pre-installed panel assembly can be formed 108 by coupling 110 the anchor member to a vertical mullion, coupling 112 the vertical mullion to at least one horizontal support member to form a frame assembly and structurally glazing 114 a building panel to the frame assembly. According to exemplary embodiments, the coupling of the unified anchor assembly to the vertical mullion can be made by shear connection to for supporting the mullion and panel assembly in shear. More particularly, a flange of the anchor fist can be oriented flush against the side surface of the vertical mullion and fastener can be inserted through an opening in the flange and into the mullion. The fastener can be tightened to be oriented in a second lateral direction.

As shown schematically in FIG. 7, an embed angle can be secured 116 to a top surface of a building floor slab proximate its terminal edge. The pre-installed panel assembly can be secured 118 to the building by seating the anchor fork of the anchor member on the embed angle. More particularly, the downward-opening slot of the anchor member can be positioned over and receive at least a top portion of a vertically-oriented flange of the embed angle. A fastener can be further used to secure the anchor fork to the embed angle by a fastener extending through the tines of the fork and the upwardly extending flange of the embed angle.

Horizontal adjustment of the panel assembly can be made 120 by disengaging the serrated segments of the blade portion and the anchor fork, moving or sliding the anchor fork relative the blade portion, and reengaging the serrated segments so that the serrated segment of the anchor fork engages a different portion of the serrated segment of the blade portion. It will be understood that the slotted channel along at least a portion of the length of lade portion 24 can facilitate such horizontal adjustment. The fastener extending through the slotted opening of blade portion and anchor fork can be tightened to secure the lateral position of the anchor fork relative the blade portion. The horizontal adjustment of the anchor fork relative the blade portion being sufficient to enable reciprocal horizontal adjustment of the panel assembly relative the building floor slab. Such horizontal adjustment can enlarge or restrict the gap between the terminal edge of the floor slab and the inside edge of the vertical mullion.

Vertical adjustment of the panel assembly can be made 122 by rotating a fastener along the head of the blade portion. The head of the blade portion being received within a vertically oriented channel of the anchor fist. The rotation of the fastener, causing the blade portion of the anchor member to move vertically relative the anchor fist. Such vertical movement enabling reciprocal vertical adjustment of the panel assembly relative the building floor slab so that the panel assembly can be raised and lowered into the desired elevation relative the floor slab and adjacent panel assemblies.

Methods according to exemplary embodiments shown schematically in FIG. 7 can further comprise applying 124 fire safing along an interior notched section of vertical mullion between the interior side of mullion and the terminal edge of floor slab. Due to the structure of the anchor assembly presented herein and the fact that it does not require a continuous shelf to support the façade, embodiments presented herein can enable visual verification of the fire safing to reliably confirm proper compression and the absence of voids which is tremendously important in being able to provide reliable fire-resistance capability. Embodiments can further include the application of a smoke seal 126 such as a fluid-applied liquid smoke seal, above at least a portion of the firesafing adjacent the edge of the building floor slab to further seal the gap between the slab and the mullion. The smoke seal can form a seal between the horizontal head member and building floor slab.

According to exemplary embodiments shown schematically in FIG. 7, exemplary methods can further comprise providing a floor closure sub-assembly having a vertically adjustable interior trim angle held in place by compression of adjacent gaskets wherein the adjustable interior trim angle is slidably adjustable in a substantially vertical direction to interface an interior finish of the building floor slab. Methods provided herein can comprise securing 128 the floor closure sub-assembly to at least one of the horizontal members of the panel assembly and sealing 130 an opening or space between the top surface of the floor slab FS or interior floor surface and the interior trim assembly by slidably adjusting an interior trim index in a substantially vertical direction towards the floor slab.

From the foregoing, it will be observed that numerous variations and modifications may be affected without departing from the spirit and scope of the invention. It is to be understood that no limitation with respect to the specific apparatus illustrated herein is intended or should be inferred. It is, of course, intended to cover by the appended claims all such modifications as fall within the scope of the claims. From the foregoing, it will be seen that this invention is one well adapted to attain all the ends and objects hereinabove set forth together with other advantages which are inherent to the structure. It will be understood that certain features and sub combinations are of utility and may be employed without reference to other features and sub combinations. Since many possible embodiments of the invention may be made without departing from the scope thereof, it is also to be understood that all matters herein set forth or shown in the accompanying drawings are to be interpreted as illustrative and not limiting.

Further, logic flows depicted in the figures do not require the particular order shown, or sequential order, to achieve desirable results. Other steps may be provided, or steps may be eliminated, from the described flows, and other components may be added to, or removed from the described embodiments.

What is claimed is:

1. A building facade system having a unified anchor assembly comprising:

an anchor member comprising:

a blade portion having a proximal end with a head, an opposing distal end and a lateral surface having serrations along at least a portion of a length of the blade portion between the proximal and distal ends, the length of the blade portion extending in a first direction, a slotted opening extending along at least a portion of the length of the blade portion in the first direction, the slotted opening extending through the blade portion between the lateral surface having the serrations and an opposing surface of the blade portion, the serrations on the lateral surface of the blade portion having a series of alternating elongated ridges and grooves extending in a second direction substantially perpendicular to the first direction;

an anchor first having a channel and a flange, the channel being configured to receive the head of the blade portion, the head being configured to slidably engage within the channel in the second direction, and an anchor fork having a pair of tines defining a slot with an opening therebetween, the anchor fork having a serrated lateral surface along at least a portion thereof, the serrated lateral surface of the anchor fork having a series of alternating elongated ridges and grooves extending in the second direction, the serrated lateral surface of the anchor fork being configured to engage the serrations of the blade portion, the anchor fork and blade anchor being an assembly of two parts secured together by a fastener extending in a third direction substantially perpendicular to the first and second directions; wherein upon installation onto a building, the anchor fork being oriented so that the opening of the slot of the anchor fork is downward-facing, the anchor fork being seated on an upwardly extending flange of a structural member affixed to a building floor slab proximate a terminal edge of the building floor slab, the flange of the structural member extending into the slot of the anchor fork, the blade portion extending in the first direction which is a substantially lateral first direction, the channel of anchor first extending in the second direction which is a substantially vertical direction, the anchor first being secured to a vertical mullion by shear connection, the shear connection being made by fasteners coupling the flange of the anchor first to a lateral surface of the mullion.

2. The building facade system of claim 1 wherein the unified anchor assembly includes a plurality of anchor members, at least two of the plurality of anchor members being secured to opposing lateral sides of the vertical mullion, the serrations of the blade portion of each anchor member facing one another.

3. The building facade system of claim 1 wherein the unified anchor assembly is part of a panel assembly comprising a panel frame and an infill panel, the panel frame being comprised of the vertical mullion and horizontal supports coupled thereto, the infill panel being supported on the panel frame.

4. The building facade system of claim 3 further comprising the panel assembly.

5. The building facade system of claim 1 wherein the structural member is an embed angle having a second flange secured to the floor slab, the second flange being substantially perpendicular to the upwardly extending flange.

6. The building facade system of claim 5 further comprising the embed angle.

7. The building facade system of claim 1 wherein vertical adjustment of the anchor assembly relative the building floor slab can be provided by movement of the head of the blade portion within the channel of the anchor fist, such vertical movement being facilitated by rotation of fasteners within the channel against the head portion.

8. The building facade system of claim 1 wherein horizontal adjustment of the anchor assembly relative the building floor slab can be provided by disengagement of the serrations of the blade portion with the serrated portion of the anchor fork, sliding the blade portion laterally relative the anchor fork, the fastener extending through the slotted opening being slid laterally therein, the serrations of the blade portion being reengaged with the serrated portion of the anchor fork along a different section thereof, the slotted.

9. A building facade system comprising:

a panel assembly comprising a panel frame and an infill panel, the panel frame being comprised of vertical mullions and horizontal supports coupled thereto and framing the infill panel, the infill panel being supported on the panel frame;

a unified anchor assembly comprising an anchor member comprising:

a blade portion having a proximal end with a head, an opposing distal end and a lateral surface having serrations along at least a portion of a length of the blade portion between the proximal and distal ends, the length of the blade portion extending in a first direction, a slotted opening extending along at least a portion of the length of the blade portion in the first direction, the slotted opening extending through the blade portion between the lateral surface having the serrations and an opposing surface of the blade portion, the serrations on the lateral surface of the blade portion having a series of alternating elongated ridges and grooves extending in a second direction substantially perpendicular to the first direction;

an anchor first having a channel and a flange, the channel being configured to receive the head of the blade portion, the head being configured to slidably engage within the channel in the second direction, and an anchor fork having a pair of tines defining a slot with an opening therebetween, the anchor fork having a serrated lateral surface along at least a portion thereof, the serrated lateral surface of the anchor fork having a series of alternating elongated ridges and grooves extending in the second direction, the serrated lateral surface of the anchor fork being configured to engage the serrations of the blade portion, the anchor fork and the blade anchor being a two-part assembly secured together by a fastener extending in a third direction substantially perpendicular to the first and second directions; wherein upon installation onto a building, the anchor fork being oriented so that the opening of the slot of the anchor fork is downward-facing, the anchor fork being seated on an upwardly extending flange of a structural member affixed to a building floor slab proximate a terminal edge of the building floor slab, the flange of the structural member extending into the slot of the anchor fork, the blade portion extending in the first direction which is a substantially lateral direction, the channel of anchor first extending in the second direction which is a substantially vertical direction, the anchor first being secured to at least one of the vertical mullions by shear connection, the shear connection being made by fasteners coupling the flange of the anchor first to a lateral surface of the at least one vertical mullion.

10. The building facade system of claim 9 wherein the unified anchor assembly includes a plurality of anchor members, at least two of the plurality of anchor members being secured to opposing lateral sides of the at least one vertical mullions, the serrations of the blade portion of each anchor member facing one another.

11. The building facade system of claim 9 wherein the unified anchor assembly is affixed to the panel assembly and installed onto a building as a single unit.

12. The building facade system of claim 9 wherein the structural member is an embed angle having a second flange secured to the floor slab, the second flange being substantially perpendicular to the upwardly extending flange.

13. The building facade system of claim 9 further comprising the embed angle.

14. The building facade system of claim 9 wherein vertical adjustment of the anchor assembly relative the building floor slab can be provided by movement of the head of the blade portion within the channel of the anchor fist, such vertical movement being facilitated by rotation of fasteners within the channel against the head portion.

15. The building facade system of claim 9 wherein horizontal adjustment of the anchor assembly relative the building floor slab can be provided by disengagement of the serrations of the blade portion with the serrated portion of the anchor fork, sliding the blade portion laterally relative the anchor fork, the fastener extending through the slotted opening being slid laterally therein, the serrations of the blade portion being reengaged with the serrated portion of the anchor fork along a different section thereof, the slotted.

16. The building facade system of claim 14 wherein the vertical adjustment of the anchor assembly actuates vertical adjustment of the panel assembly relative the floor slab.

17. The building facade system of claim 15 wherein the horizontal adjustment of the anchor assembly actuates horizontal adjustment of the panel assembly relative the floor slab, such horizontal adjustment altering a width of a gap between the terminal edge of the floor slab and an inside edge of the vertical mullion.

18. The building facade system of claim 9 wherein the infill panel is structurally glazed onto the frame and is comprised of a material selected from a group consisting of solid, perforated or patterned, steel, aluminum, glass, gfrc, porcelain, sintered stone, stone and polymers.

19. A method of providing a building facade system comprising:

providing a unified anchor assembly having an anchor member comprising a blade portion, an anchor first and an anchor fork, the blade portion having a proximal end with a head, an opposing distal end and a lateral surface having serrations along at least a portion of a length of the blade portion between the proximal and distal ends, the length of the blade portion extending in a first direction, a slotted opening extending along at least a portion of the length of the blade portion in the first direction, the slotted opening extending through the blade portion between the lateral surface having the serrations and an opposing surface of the blade portion, the serrations on the lateral surface of the blade portion having a series of alternating elongated ridges and grooves extending in a second direction substantially perpendicular to the first direction, the anchor first having a channel and a flange, the channel being configured to receive the head of the blade portion, the head being configured to slidably engage within the channel in the second direction, the anchor fork having a pair of tines defining a slot with an opening therebetween, the anchor fork having a serrated lateral surface along at least a portion thereof, the serrated lateral surface of the anchor fork having a series of alternating elongated ridges and grooves extending in the second direction, the serrated lateral surface of the anchor fork being configured to engage the serrations of the blade portion, the anchor fork and the blade anchor being a two-part assembly secured together by a fastener extending in a third direction substantially perpendicular to the first and second directions;

securing the blade portion within the channel of the anchor first and securing the anchor fork to the body of the blade portion by a threaded fastener extending through the slotted opening of the blade portion and into the anchor fork;

orienting the anchor fork such that tines extend downward below the blade portion with the opening therebetween opening downward;

forming a panel assembly by coupling the anchor member to a vertical mullion, coupling the vertical mullion to at least one horizontal support member to form a frame assembly and structurally glazing a building panel to the frame assembly, the coupling of the anchor member to the vertical mullion being a shear connection whereby the flange of the anchor first can be oriented flush against the side surface of the vertical mullion and a fastener can be inserted through an opening in the flange and into the mullion;

securing a structural member to a top surface of the building floor slab proximate the terminal edge, and securing the panel assembly to the building by seating the anchor fork of the anchor member on an upwardly extending flange of the structural member.

20. The method of claim 19 further comprising making horizontal and vertical adjustment of the anchor assembly relative the building floor slab, the vertical adjustment being made by moving the head of the blade portion within the channel of the anchor first by rotating fasteners within the channel against the head portion, the horizontal adjustment being made by disengaging the serrations of the blade portion with the serrated portion of the anchor fork, sliding the blade portion laterally relative the anchor fork, laterally sliding the fastener extending along the slotted opening, reengaging the serrations of the blade portion with the serrated portion of the anchor fork along a different section thereof.

* * * * *